US006227017B1

(12) United States Patent
Igelmund

(10) Patent No.: US 6,227,017 B1
(45) Date of Patent: May 8, 2001

(54) COMPUTER SLOT SECURITY ADAPTOR

(76) Inventor: Darrell A. Igelmund, 3602 Lake Washington Blvd. North, Renton, WA (US) 98056

( * ) Notice: Subject to any disclaimer, the term of this patent is extended or adjusted under 35 U.S.C. 154(b) by 0 days.

(21) Appl. No.: 08/226,564

(22) Filed: Apr. 12, 1994

(51) Int. Cl.[7] ..... E05B 69/00
(52) U.S. Cl. ..... 70/58; 70/58; 70/14
(58) Field of Search ..... 70/14, 18, 32, 70/34, 57, 58, 232, 423, 424, 426, 428, 430; 248/505, 551, 553

(56) References Cited

U.S. PATENT DOCUMENTS

| | | | | |
|---|---|---|---|---|
| 606,734 | * | 7/1898 | Olmstead | 70/428 |
| 611,646 | * | 10/1898 | Parker | 70/428 |
| 881,364 | * | 3/1908 | Wheeler | 70/428 |
| 1,025,724 | * | 5/1912 | Snyder | 70/58 |
| 1,050,276 | * | 1/1913 | Johnson | 70/424 |
| 1,470,937 | * | 10/1923 | Schou | 70/428 |
| 2,172,208 | * | 9/1939 | Kurtzon | 70/14 |
| 2,561,029 | * | 7/1951 | Mason | 70/428 |
| 2,677,261 | * | 5/1954 | Jacobi | 70/32 |
| 4,057,984 | * | 11/1977 | Avaivsini | 70/58 |
| 4,843,848 | * | 7/1989 | Iglemund | 70/58 |
| 5,007,256 | * | 4/1991 | Lowe | 70/14 |
| 5,063,763 | * | 11/1991 | Johnson | 70/58 |
| 5,082,232 | * | 1/1992 | Wilson | 248/551 |
| 5,327,752 | * | 7/1994 | Myers | 70/58 |
| 5,381,685 | * | 1/1995 | Carl | 70/58 |
| 5,502,989 | * | 4/1996 | Murray | 70/58 |

* cited by examiner

*Primary Examiner*—Gary W. Estremsky
(74) *Attorney, Agent, or Firm*—Richardson & Folise

(57) ABSTRACT

A security device for securing portable equipment having a security slot in the chassis of the equipment, comprising an attachment having a slot-mating head and an axially movable head locking member which is inserted into the slot after the head to prevent rotation and removal of the head from the slot.

8 Claims, 4 Drawing Sheets

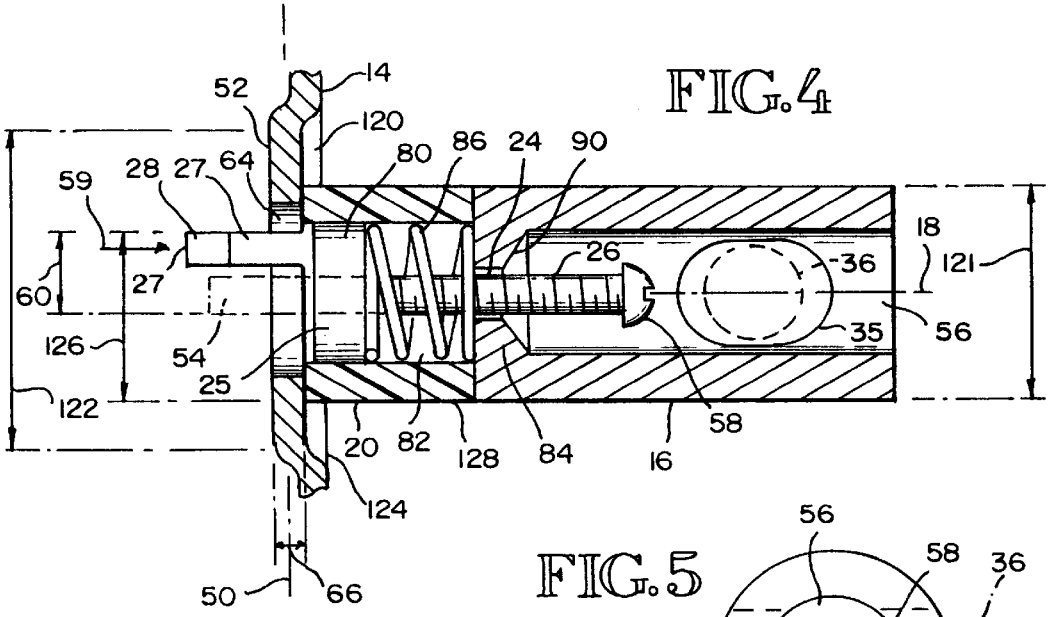
FIG. 4
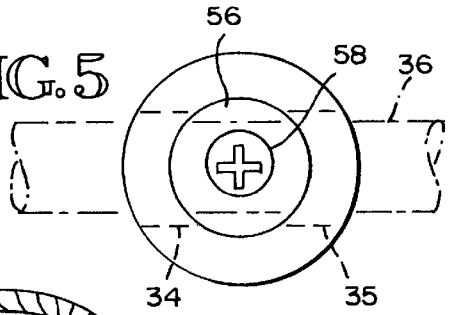
FIG. 5
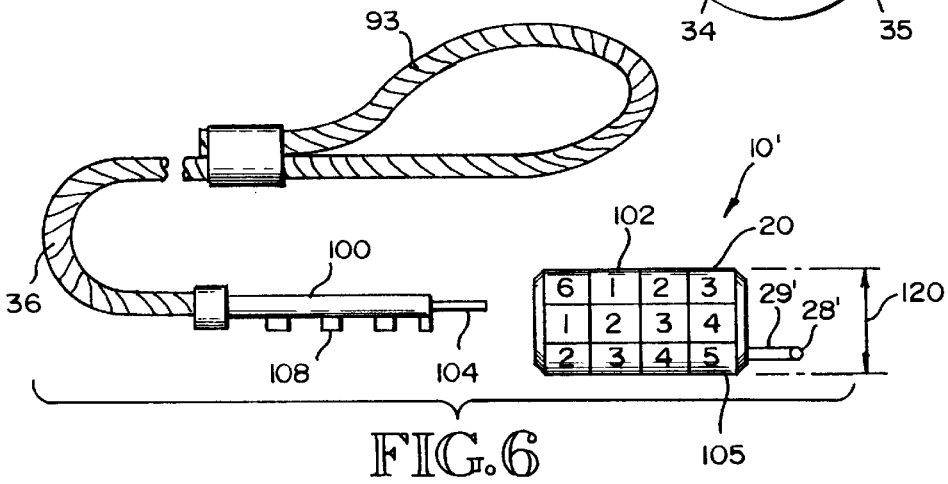
FIG. 6
FIG. 6A
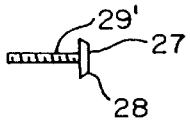

FIG. 9
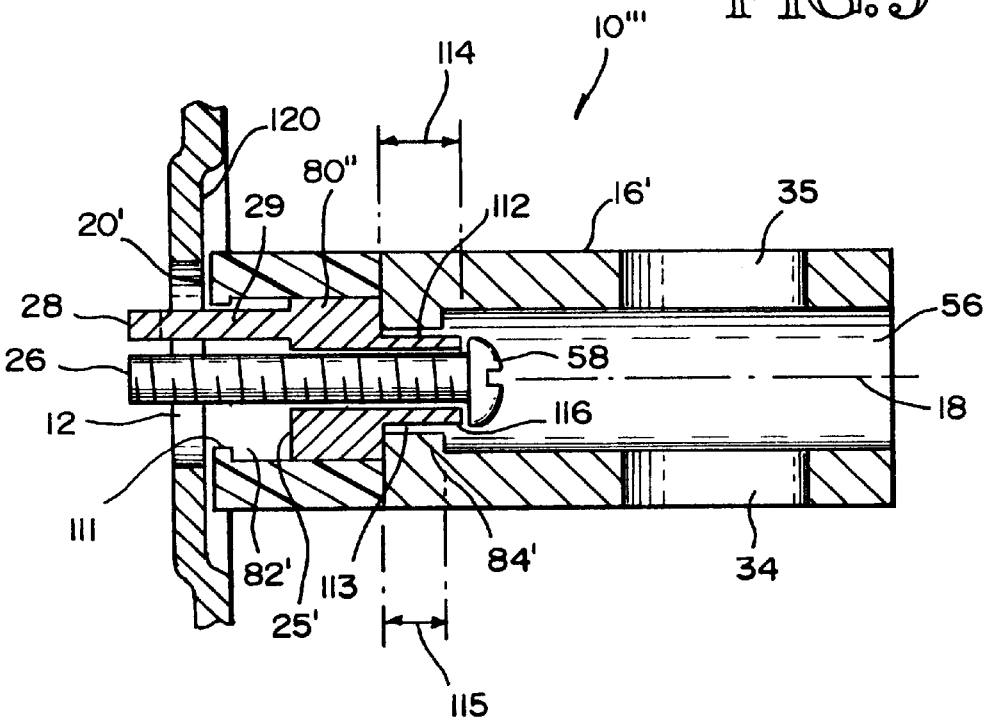
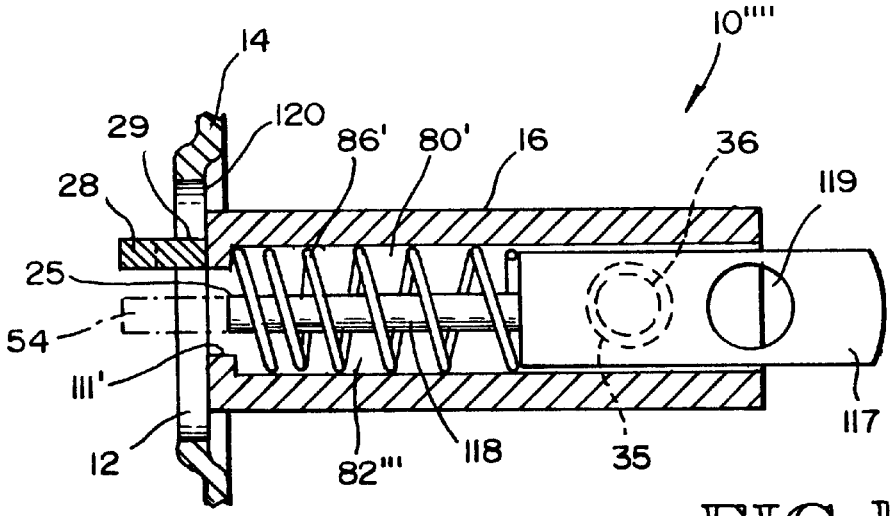
FIG. 10

COMPUTER SLOT SECURITY ADAPTOR

TECHNICAL FIELD

The invention relates to security devices for portable equipment. More specifically, the invention relates to devices used to prevent theft of computers and other office equipment.

BACKGROUND OF THE INVENTION

Theft of portable equipment such as personal computers and other office equipment is widespread and imposes significant costs on individuals and businesses. Developing a common security solution to prevent theft of portable equipment has proven challenging, because portable equipment varies so much in terms of size, shape and construction. Accordingly, previous attempts to provide a common, inexpensive and secure method to protect even a single class of portable equipment, such as personal computers, have been largely unsuccessful.

One particular type of security device for portable equipment uses interlocking plates to affix the underside of an office equipment unit to a work surface. U.S. Pat. No. 4,655,429 to Gaensle et al. (1987) discloses fixture with plates and a bonding method to secure them. Other methods have the user drill holes in the work surface to bolt the interlocking plates together from underneath.

These methods are satisfactory for certain applications, but are generally unacceptable because they make movement of the equipment time consuming and difficult when offices are relocated, sometimes forcing permanent modifications to be made to the equipment or anchoring surface, and do not allow the user the option of repositioning the equipment once it has been installed. In addition, many of these devices must be manufactured to fit the specific geometry of the machines they secure, making them expensive to manufacture and purchase.

Another class of devices that share many of these same drawbacks encase the equipment to be protected in a protective housing using various methods to anchor the housing to a secure location. Several types of these devices have been disclosed. For example, U.S. Pat. No. 4,123,922 to Kuenstler (1978) describes various means to lock equipment inside a protective housing. U.S. Pat. No. 4,252,007 to Kerley (1981) discloses a protective housing of similar intent but different design. Although appropriate for certain applications, these devices must be designed to house a particular size and shape of equipment, making them expensive to manufacture and purchase. In addition, they have the drawback of dramatically altering the appearance of the office equipment.

To overcome these objections consumers have resorted to security devices that have more flexible anchoring methods. Many of these devices utilize steel cable, sometimes referred to as "wire rope", to tether personal computers and other office equipment in place. Some steel cable devices use existing screws to secure the cable to the office equipment. First, a bracket is mounted to the equipment using an existing screw. Then the steel cable is passed through the bracket, blocking removal of the screw. These devices can be used on a broad variety of computers, are inexpensive to manufacture and can be removed when no longer desired. However, these screw attached devices have some disadvantages. First, the security provided by this method is based on the strength of the screw arrangement which anchors the bracket. Most personal computers have relatively small, frail screws. Additionally, the surfaces that they screw into are generally thin and easily stripped by wrenching forces on the cable and screw. Consequently, a thief, depending on the personal computer, could dislodge the bracket with a good quick tug. Another disadvantage is the difficulty that users encounter mounting these devices. Many users have a difficult time visualizing how these devices are utilized and installed.

Another steel cable device uses a tether to anchor a housing that encases the equipment. This approach has the same drawbacks as the other protective housing approaches mentioned above. They are expensive and dramatically alter the appearance of the equipment they are protecting.

Still other office equipment steel cable devices, as disclosed in U.S. Pat. No. 3,785,183 to Sander (1974), U.S. Pat. No. 3,859,826 to Singer et. al. (1975), U.S. Pat. No. 3,990,292 to Shontz (1992) and U.S. Pat. No. 4,310,371, to Herwick et. al. (1981), focus on elaborate keylock assemblies. These devices are expensive and fail to provide a simple and widely applicable method to attach the steel cable to a personal computer or other office equipment. For attaching the cable to equipment to be secured, Sanders suggests making a hole in the equipment to take advantage of the disclosed lock and back plate assemblies. Most users find this unacceptable because they do not wish to drill into the equipment for fear of violating the warranty or damaging the equipment. Singer et. al. suggests using tamper proof screws to attach to the equipment to take advantage of the disclosed locking assembly. This assumes that there are suitable screw mounting sites that are in the necessary location to mate with the particular security plate for the equipment. Additionally, security screws are only suitable as long as a thief does not have the correct screwdriver. Shontz suggests drilling a hole in the office equipment, finding a suitably located and sized hole, or adapting a plate to fit existing nuts and bolts to mount the cable. This approach has many of the same disadvantages that are apparent in the Sander disclosure.

A more satisfactory means for securing portable equipment has been developed which takes advantage of existing plates or fittings on the equipment to provide anchoring attachments for security fittings. Such security devices replace the plate or fitting with a security fixture which is designed to be securely mounted in the original location of the plate or fitting. Ideally, such devices are mounted without exposed screws or bolts which may be removed by unauthorized persons. One such security device specifically designed for personal computers is a mechanical security fixture which mounts to a standard expansion slot opening in the personal computer chassis. This security fixture can be used on a broad range of personal computers, can be securely mounted without exposed screws or bolts, and takes advantage of the integrity of the computer chassis to provide a strong mounting location for the security fixture.

A recent development in the field of security devices for portable equipment has been the use of security fixtures which are specifically designed to mate with standardized openings manufactured into the chassis of the equipment. One such chassis mating fixture commonly used in personal computers and other portable office equipment is a lockable mating fixture manufactured by Kensington, Inc., San Mateo, Calif., adapted to mate with standardized, oval shaped security slots manufactured into the chassis of the equipment. Such security slots are now routinely provided for a range of portable computers, such as laptop and notebook computers sold under the Macintosh® trademark (Apple Computers, Inc., Cupertino, Calif.), as well as manufactured by Dell® (Austin, Tex.), AST® (Irvine, Calif.), and Toshiba USA® (Irvine, Calif.), among others. The slots are designed to lockably engage a t-shaped head connected by a rotatable shaft to the security fixture which is in turn anchored to a stationary object by an anchoring tether.

To attach the Kensington fixture to the portable equipment, the head is inserted into the slot through the wall of the chassis of the equipment and the shaft is then rotated by insertion and rotation of a key into the device. This rotates the head out of line with a longitudinal axis of the slot into an engaged position, so that removal of the head is blocked by an interior wall of the chassis surrounding the slot. Removal of the head can then only be accomplished if the head is further rotated or counter-rotated to realign the head with the longitudinal axis of the slot.

To prevent counter-rotation and removal of the head once it is engaged, the Kensington device provides an elaborate head locking system. The system includes a head locking mechanism consisting of two pins mounted on either side of the shaft in line with an insertion plane defined by the head and shaft when the head is in the non-engaged position. The length of a horizontal, slot-mating portion of the head, and the spacing between the locking pins, approximates the length of the slot so as to enable simultaneous insertion of the head and pins into the slot. once the head and pins are inserted into the slot, the shaft and head are rotated about the shaft axis, while the pins remain stationary in the slot. Once the key is removed, the head becomes locked in the engaged position and cannot be independently angularly rotated about the longitudinal axis of the shaft relative to the pins, which themselves cannot be angularly rotated with respect to the shaft axis because such action is blocked by sidewalls of the slot.

While the Kensington device features a number of advantages over alternative security devices for portable equipment, it also features a number of disadvantages. Primary among these disadvantages is the complex head locking system which imposes extensive manufacturing costs. In addition, use of the Kensington device is limited to portable equipment manufactured to include a security slot opening in the chassis, making the device incompatible with a wide range of portable equipment.

Accordingly, a need exists in the art for a security fixture for securing portable equipment having a security slot opening in the chassis of the equipment, which is simple in design and inexpensive to manufacture. In addition, there is a need in the art for a means of adapting portable equipment which has not been manufactured to include a slot opening to make such equipment securable by slot-mating security fixtures.

SUMMARY OF THE INVENTION

It is therefore an object of the present invention to provide a slot-mating security device which is simple in design and inexpensive to manufacture.

It is a further object of the invention to provide a method and device for modifying portable equipment which does not have a security slot opening to make the equipment compatible for use with slot-mating security fixtures.

The invention achieves these objects and other objects and advantages which will become apparent from the description which follows by providing a slot-mating security fixture which has a slot-mating head including a transverse limb attached by a shaft to a main body, and an elongated, axially moveable head locking member to prevent counter-rotation of the head out of an engaged position.

In the preferred embodiment, the head includes two transverse limbs so that the head and shaft make up a t-shaped extension from the body. The body defines a main axis and has a head locking aperture for permitting axial movement of an elongated head locking member. The head locking member is independently axially moveable with respect to the head to allow for independent insertion of the head locking member into the slot after the head has been inserted and rotated in the slot to an engaged position. After the head is engaged, the head locking member is axially advanced through the aperture into the slot, thereby preventing rotation or counter-rotation of the head so that the head is locked in the engaged position. In addition, the invention provides a mechanism for concealing the head locking member after it has been advanced through the aperture into the slot, so that the head locking member cannot be retracted from the slot. The security device can also be attached to an anchoring tether. In alternate embodiments, the security fixture compensates for different slot wall thicknesses, and is provided with alternative cable locking mechanisms.

The design of the body, head and head locking member is simple, yet obviates the need for an elaborate head locking system requiring independent angular adjustability and lockability between the head relative to the head locking mechanism.

BRIEF DESCRIPTION OF THE DRAWINGS

FIG. 4 is a cross-sectional view, similar to FIG. 3, showing the head of the security device having been inserted and rotated in the security slot.

FIG. 5 is an end plan view of the security device showing a portion of an anchoring tether in phantom threaded through anchoring holes in the terminal end of the body of the device, and a screw head.

FIG. 6 is a side elevational view showing an alternate embodiment of the device which has a male locking pin as the head locking member and a body which includes a combination lock housing for lockably engaging the pin.

FIG. 6*a* ia a side elevational view of a slot mating head having a threaded shaft for mating with a cooperatively threaded receptacle at the mounting end of the device, to provide for axial adjustability of the head.

FIG. 9 is a cross-sectional, isometric view of a simplified embodiment of the invention showing the head locking member axially advanced into a head locking position. FIG. 10 is a cross-sectional, isometric view of another simplified embodiment of the invention having a unitary body and a head locking member mounted on an axially adjustable and securable push-button.

DETAILED DESCRIPTION OF THE PREFERRED EMBODIMENTS

Figure 1:
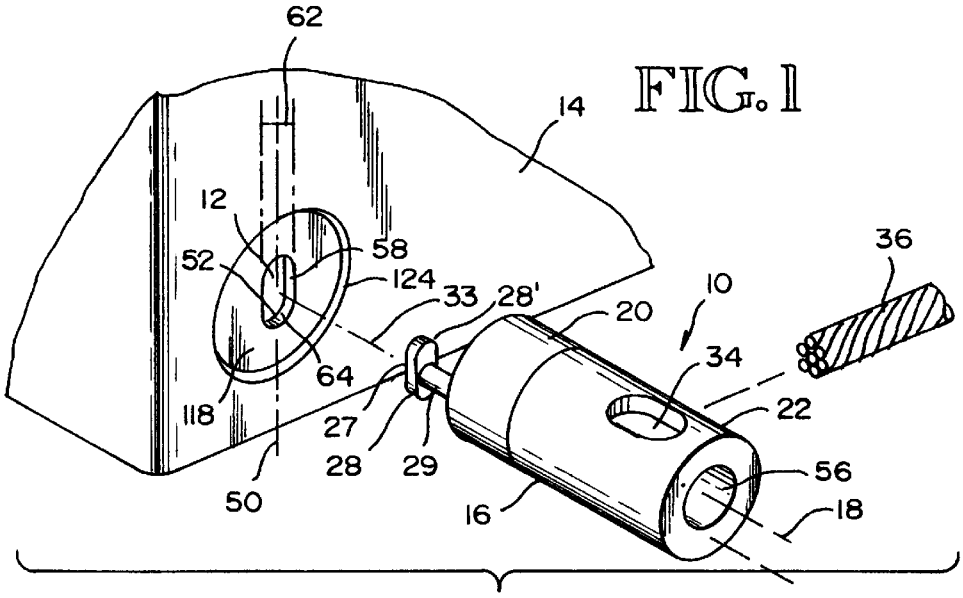
FIG. 1 is an environmental view showing a cut away portion of a computer chassis having a standard security slot opening, and an unmounted security device employing the concepts of the present invention.
Figure 3:
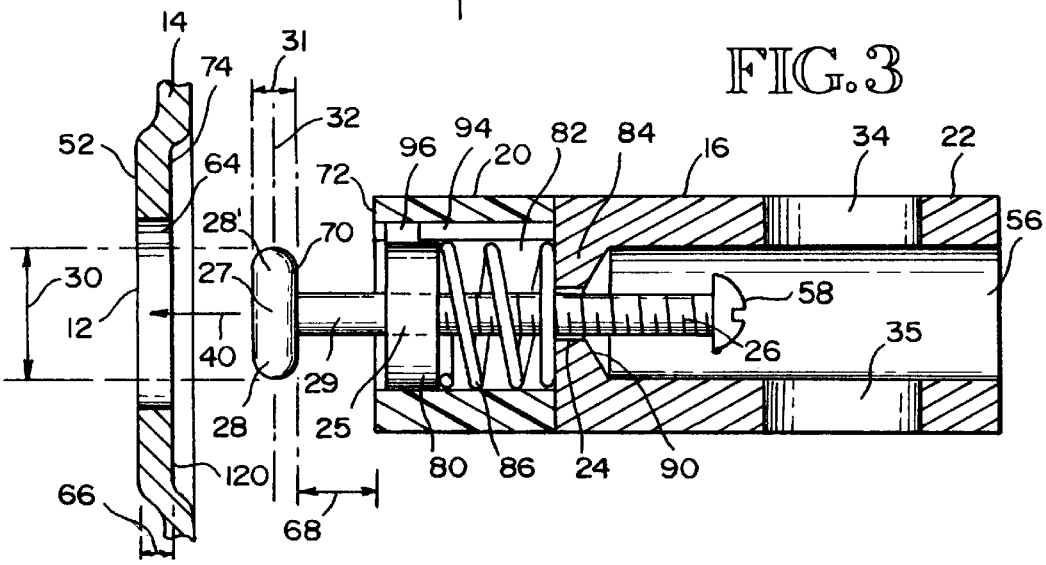
FIG. 3 is a cross-sectional view of the device shown in FIG. 2 taken along line 3—3 of FIG. 2.

A security device employing the principles of the present invention is generally indicated at reference numeral 10 in FIG. 1. The device is about to be mounted into a standard security slot 12 of a chassis 14 of a portable equipment unit. The device includes a main body 16 defining a central axis 18, a mounting end 20 and a terminal end 22. As shown in FIGS. 3 and 4, the body further defines a head locking bore 24 and a threaded head locking aperture 25 for engaging a head locking member, or screw 26.

Referring to FIGS. 1 and 3, the security device 10 also features a slot-mating head 27 including a transverse limb 28 sized for insertion into the security slot 12. The head is supported on a perpendicular shaft 29 attached to the mounting end 20. The preferred head has two transverse limbs, 28, 28' so that the head and shaft form a t-shaped extension from the body, and has an overall length 30 of approximately 7–8 mm, and a width 31 of approximately 3 mm. A head axis 32 and a shaft axis 33 (see FIG. 2) define an insertion plane which, in order for proper functioning of the security device, must be substantially parallel to, but not include, longitudinal axes of the bore 24 and aperture 25 which are coincident with the main axis 18.

In addition to these features, the security device 10 also includes a pair of diametrically opposed, transverse holes 34, 35 in the terminal end 22 of the body 16 for accepting an anchoring tether 36, as shown in FIGS. 1, 3–5, 8 and 9.

The security device 10 of the present invention can be mounted to any portable equipment which has an elongated security slot 12 in the chassis 14. As represented in FIGS. 1 and 3, the device is mounted by inserting the head 27 into the slot in the direction of the insertion arrow 40 while the insertion plane includes a longitudinal axis 50 of the slot opening 12. The head is advanced until it has passed beyond an inner wall 52 of the chassis 14. At this point during mounting, the device 10 is rotated angularly with respect to the shaft axis 33 until the screw 26 is aligned with the slot (compare FIGS. 3 and 4). In the engaged position, shown in FIG. 4, the head 27 cannot be removed from the slot opening 12 without being further rotated or counter-rotated, because removal of the head in a direction opposite to the insertion arrow 40 is blocked by contact between the transverse limb 28 of the head and the inner wall 52 of the chassis. Although a single limb is sufficient to prevent rearward removal of the head, two limbs 28, 28' provide better anchorage against the inner chassis wall and are therefore preferred.

At this point during mounting, the head locking screw 26 can be advanced through the bore 24 and aperture 25 in the direction of the insertion arrow 40 so that the screw passes through the aperture into the slot opening 12 to a head locking position 54. The screw is advanced by inserting a screwdriver into a blockable, longitudinally directed access opening 56 defined by the terminal end 22 of the body 16, and thereafter causing the screwdriver to turn a head 58 of the screw to advance the screw within the bore 24 and aperture 25. The screw must be advanced sufficiently far into the slot opening so that it remains in the slot opening if the security device is pulled away from the chassis 14 in the direction of the arrow 59 shown in FIG. 4 so that the transverse limbs 28, 28' of the head 27 are drawn against the inner chassis wall 52. Contact between the head limbs and inner wall prevents further withdrawal of the device away from the chassis so that the head locking member remains engaged in the slot opening in the head locking position.

Advancement of the screw 26 into the head locking position 54 prevents further rotation or counter-rotation of the head 27, so that the head cannot be removed from the slot 12. This is because a separation distance 60 between the screw and head shaft 29 is at least slightly wider than a width 62 of the slot opening (see FIG. 1). The separation distance between the screw and shaft is fixed, such that rotation of the head is prevented by contact of the screw and shaft 29 with side-walls 64 of the slot opening 12. This relationship prevents realignment of the head axis 32 with the slot axis 50 to allow removal of the head from the slot.

The invention also provides mechanisms for axially adjusting the head 27 relative to the body 16, to accommodate variations in thicknesses 66 (see FIGS. 3 and 4) of slot side-walls 64 among different portable equipment designs. Axial adjustability of the head is desirable because a greater degree of security is provided if the head 27 and mounting end 20 are separated by a seating distance 68 (see FIG. 3) which closely approximates the thickness of the sidewalls 64 of a particular slot opening. If the seating distance is nearly the same as the sidewall thickness, the device can be mounted with a snugger fit; i.e. after insertion and rotation of the head 27, a rear surface 70 of the head limbs 28, 28' preferably seats against the inner wall 52 of the chassis 14, while a front surface 72 of the mounting end snugs against an outer wall 74 of the chassis (see FIG. 3). The closer the match between the sidewall thickness 66 and seating distance 68, the less play there is for manipulating the device after mounting. This reduces the risk that a thief may be able to joggle the device in the slot to put force on the chassis walls 52, 74 and perhaps break the head free from the slot by disrupting the integrity of the chassis walls. In addition, the more snugly the device fits, the more appealing is the aesthetic appearance of the portable equipment after the device is mounted.

Axial adjustability of the head 27 is provided by a spring-mounted, axially adjustable head support 80 to which the shaft 29 and head are attached (see FIGS. 3 and 4). To accommodate the adjustable head support, the body has a hollow cavity 82 defined by the mounting end 20, and a transverse retaining wall 84 intermediate the mounting end and terminal end 22. The head support 80 seats like a piston within the cavity 82 and rides on a compression spring 86 mounted between the head support and retaining wall. The head locking bore 24 passes through the retaining wall 84 and is in registration with the threaded aperture 25 defined by the head support 80. The head locking screw 26 is cooperatively threaded with the aperture and is movably mounted through the bore and aperture.

In operation, the invention employs a dually functional head locking screw 26, which not only prevents rotation of the head 27 when the head and screw are engaged in the slot 12, but also controls axial adjustment of the head. To accomplish both functions, the screw 26 is advanced in the direction of the insertion arrow 40 (see FIG. 3) so that the screw passes into the slot opening 12 to the head locking position 54, as described above. When the screw is partially advanced, the screw head 58 comes into contact with a rear surface 90 of the retaining wall 84. The bore 24 is not threaded, allowing the screw to continue turning in the bore and threading through the aperture 25 after the screw head 58 contacts the rear surface of the retaining wall. This causes the head support 80 and head 27 to move axially toward the retaining wall simultaneous with advancement of the screw into the slot opening 12 toward the head locking position 54. As the screw approaches the head locking position, the seating distance 68 diminishes until it is approximately the same as the sidewall thickness 66. At this point the rear surface 70 of the head limbs 28, 28' are brought into contact with the inner chassis wall 52, and the front surface 72 of the mounting end is brought into contact with the outer chassis wall 74 to snugly mount the device. The spring 86, which need not be present, functions to resist axial movement of the head support 25, maintaining the head support in an extended position, as shown in FIG. 4, for easier mounting of the device.

Once the device 10 of FIG. 1 has been mounted, (i.e. once the head is engaged, the screw 26 is advanced to the head locking position 54, and the head is axially adjusted), the anchoring tether 36 is threaded through the anchoring holes 34, 35, as depicted in FIG. 5. A preferred type of anchoring tether is a standard anchoring cable (not shown) made of braided steel or other material resistant to cutting, having bulbous attachments at each end. After the tether is threaded through the access openings 34, 35 and an opening in a furniture frame or other relatively immovable structure, the tether is locked in a closed configuration by standard attachments which engage the bulbous enlargements and are designed to be padlocked together.

After the anchoring tether 36 is secured it also blocks access to the head locking screw 26 via the access opening 56 in the terminal end 22. The tether effectively conceals the screw head 58 so that a screwdriver cannot be used to unseat the screw and allow rotation and removal of the screw 26 from the head locking position 54.

To accommodate anchoring restrictions imposed by the stiffness of the tether 36 and the need to link the tether between the device 10 and immobile anchoring structures (eg. a table or desk frame), the invention provides a mechanism for angular rotation of the body 16 about the central axis relative to the head 27. This allows the body to be independently and selectively angularly positioned with respect to the head, the engaged position of which is dictated by the equipment and slot position, so that the anchoring holes 34, 35 can be approximately aligned with the restricted tether path.

Figure 2:
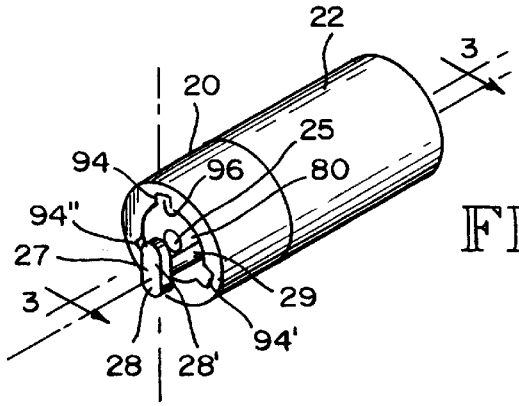
FIG. 2 is an isometric view of the invention showing the keyed, angularly adjustable head support.

Selective rotation between the head and body is accomplished by providing multiple keyways 94, 94', 94" within the hollow cavity 82 for mating with a key 96 on the head support 80 (see FIGS. 2 and 3. Using this arrangement the body 16 can be selectively rotated relative to the head support, by removing the head support from the hollow cavity and disengaging the key 96 from a first keyway 94, rotating the head support or body to align the key with a second keyway 94', 94", and then reinserting the head support into the cavity so that the second keyway engages the key. The body can thereby be oriented with the anchoring holes 34, 35 aligned with the restricted path of the tether 36. This allows for freer positioning and movement of the equipment, while preserving the ability to angularly fix the position of the head relative to the body for easier mounting.

Other embodiments of the invention are provided which avoid the use of a padlock and are thus advantageously designed for securing smaller portable equipment, such as laptop and notebook computers and calculators, which are frequently transported between locations. With such equipment it is desirable to employ a security device which may be rapidly and easily detached from the equipment. In a first alternate embodiment 10', shown in FIG. 6, One end of the anchoring tether 36 is provided with a male lock fitting 100 which is lockably interconnectable with a combination lock housing 102 which makes up the main body of the device (see FIGS. 6 and 7). The lock fitting has a slot-engaging pin 104 which functions to prevent rotation of the head 27 in the slot 12 in a similar manner as the head locking screw 26 operates in the previously described embodiments. This embodiment provides an alternate mechanism for axial adjustability of the head 27', as shown in FIG. 6*a*. The head is mounted on a threaded shaft 29' which may be adjustably advanced or retracted within a cooperatively threaded shaft opening 105 defined by the mounting end 20'. Axial adjustment of the head in this manner serves to decrease or increase the seating distance 68 to adjust for variations in slot side-wall thickness 66.

Figure 7:
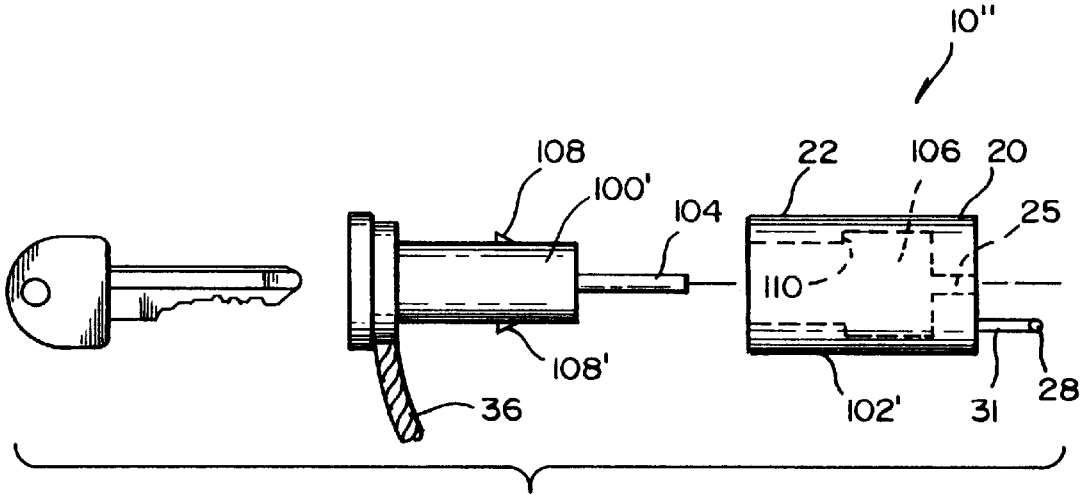
FIG. 7 is a side elevational view showing a second alternate embodiment of the device which has a key-operated male locking pin as the head locking member and a body which includes a lock housing for lockably engaging the pin.
Figure 8:
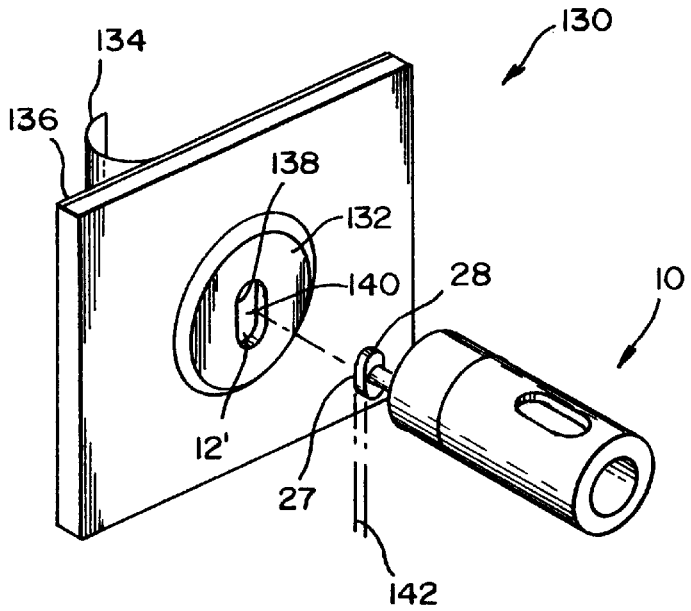
FIG. 8 is an isometric environmental view showing an unmounted security device of the invention and an adhesive-mounted slot adapter to provide portable equipment with a security slot.

A second, padlock-free alternate embodiment is shown in FIG. 7, in which the anchoring tether 36 is provided with a keyed male lock fitting 100' which is lockably interconnectable with the lock housing 102'.

To mount the embodiments 10', 10" shown in FIGS. 6 and 7, the head 27 is inserted into the slot 12 and rotated in the same manner as described for the previous embodiments. Next, the male lock fitting 100, 100' is inserted into a lock fitting receptacle 106 (see FIG. 7) defined by the lock housing 102, 102'. Upon insertion of the lock fitting into the receptacle, the pin 104 passes through the head locking aperture 25 in the mounting end 22 and into the slot opening 12 to prevent rotation of the head from the engaged position. When the lock fitting is fully inserted into the receptacle, the housing lockably engages the fitting by way of conventional locking mechanisms, such as fixed or retractable teeth 108, 108' on the male lock fitting and teeth engaging notches 110 within the receptacle for engaging the teeth, so that the pin is secured in the head locking position.

A principal advantage of these embodiments 10', 10" designed for small equipment is that the tether 36 is not attached directly to the housing 102, 102' of the security device. Rather, the tether is attached to the male lock fitting 100, 100'. Accordingly, the tether can be removed from the housing merely by dialing the appropriate combination or turning the key to disengage the fitting from the housing. This action retracts the slot-engaging pin 104 from the slot 12, allowing rotation and removal of the head 27 from the slot. This detaches the security device and frees the equipment for transportation more quickly and easily than can be accomplished with the previously described embodiments, which require that the padlock be removed from the tether locking attachments and the tether be unthreaded through the anchoring holes 34, 35, in addition to unscrewing the head locking screw 26, before the security device can be disengaged from the equipment.

A number of simplified embodiments are also provided by the present invention, including the embodiments 10''', 10'''' shown in FIGS. 9 and 10. The first simplified embodiment 10''', shown in FIG. 9, principally resembles the embodiment of FIGS. 3 and 4, but lacks a compression spring to regulate axial movement of the head support 80'. The body 16' is freely rotatable about the central axis 18 with respect to the head support. The cavity 82' defined by the mounting end 20' has a head support retaining rim 111 and a transverse retaining wall 84' for retaining the head support. The mounting end is made of a compressible material to accommodate different side wall thicknesses among security slots. The head support has a screw seating collar 112 through which the threaded head locking aperture 25' and cooperatively threaded head locking screw 26 extend. The collar is engageable within a collar opening 113 defined by the retaining wall. Importantly, a length 114 of the collar is greater than a length 115 of the collar opening, so that when the head locking screw is advanced through the aperture into the slot opening to the head locking position, as depicted in FIG. 9, the screw head 58 seats on a screw locking rim 116 of the collar. This arrangement differs from the screw head seating arrangement provided by the embodiment of FIGS. 3 and 4, wherein the screw head seats against the rear surface 90 of the retaining wall 84. The latter arrangement could create difficulties if the body 16 and head support of the embodiment of FIGS. 3 and 4 were not angularly fixed with respect to one another after mounting, due to the engagement of the head support key 96 by one of the keyways 94, 94', 94". If such angular fixation between the head and body were not provided, a thief could conceivably unscrew the screw out of the head locking position 54 by pulling the body away from the chassis 14 and rotating the body so that friction between the screw head and rear surface of the retaining wall caused the screw to become unthreaded from the head locking aperture 25 and disengaged from the slot opening 12. This potential problem is avoided by the collar seating arrangement provided in the embodiment of FIG. 9. Although this embodiment features free angular rotatability between the body and head support, the seating of the screw head against the screw locking rim 116 of the collar 112 prevents the application of friction to unthread the screw by rotation of the body.

In another simplified embodiment of the invention, shown in FIG. 10, the body 16 is unitarily constructed, and the head 27 and shaft 29 are directly connected to the body. The retaining rim 111' of the cavity 80" is designed for retaining the compression spring 86', which regulates axial movement of an engagement piston 117. The head locking member is a pin 118 connected to the engagement piston. To mount this embodiment, the head is inserted and rotated in the slot opening 12, as described previously, and as shown in FIG. 9. Next, the pin is advanced through the head locking aperture 25 into the slot opening by using a thumb to apply force to the engagement piston to compress the spring and drive the piston axially toward the chassis 14, so that the pin is advanced into the head locking position 54. The piston has a transverse, piston locking channel 119 which is alignable with the anchoring holes 34, 35 when the piston has been advanced sufficiently to drive the pin into the head locking position. The piston locking channel may be a transverse notch or bore in the piston, and its function is to secure the head locking pin in the head locking position. This is accomplished by threading the anchoring tether 36 through both the anchoring holes, and simultaneously through the piston locking channel, whereafter the piston cannot be axially repositioned to allow disengagement of the pin from the slot opening.

For optimal manufacturing and performance purposes, it is desirable to build the security device so that the longitudinal axes of the head locking aperture 25 and head locking member, eg. screw 26 or pin 104, 118, are collinear with the central axis 18 of the body 16, and so that the head shaft 29 is parallel to the central axis. This is due in part to size constraints on the device imposed by aesthetics and by the particular design of certain types of portable equipment. In general, it is aesthetically desirable to limit the size of the device, because a bulky fitting may appear ungainly attached to a streamlined or sophisticated portable equipment unit such as a computer. In addition, many portable equipment units are manufactured with the slot opening 12 located in a circular well, or mounting depression 120, in the chassis (see FIG. 4). To be mounted properly, a maximum width 121 of the mounting end 20 of the device must be the same as, or smaller than, a minimum diameter 122 of the mounting depression. Otherwise the mounting end will not seat snugly against the outer chassis wall 74 surrounding the slot opening 12. A standard minimum diameter for a mounting depression in a personal computer chassis is approximately 26 mm. Accordingly, a security device for use with such equipment should have a maximum mounting end width of equal or lesser size.

These size constraints impose an additional constraint in terms of location of the head locking screw 26 or pin 104, 118. The maximum width 121 of the mounting end 20 must be less than or equal to the diameter 122 of the mounting depression 120, so it is preferable to have the longitudinal axes of the screw or pin collinear with the central axis 18. This is because the screw or pin is necessarily bulky, so to place them eccentrically would require increased width of the mounting end. In addition, collinear placement of the screw axis provides for smoother angular rotation of the body relative to the head support 80, because the central axis 18 is collinear with the aperture 25 and bore 24 through which the screw 26 passes.

If the screw 26 axis is placed collinear with the central axis, it then becomes necessary to make the mounting end width 121 somewhat smaller than the diameter 122 of the mounting depression 120. This is because the central axis of the screw and male lock fittings must be outside of the insertion plane defined by the head 27 and shaft 29 for proper functioning of the device. Accordingly, the shaft is preferably located eccentrically relative to the central axis 18. However, when the head is inserted into the slot opening 12, the shaft must be positioned at the midpoint of the slot, which is also the center of the depression. This means that the body cannot be centered relative to the depression during mounting. At the same time, the mounting end 20 must be positioned very close to the outer chassis wall 74 to allow the head to be inserted in the slot opening. Unless the mounting end width is somewhat smaller than the diameter of the depression, part of the mounting end will contact a lip 124 of the depression during mounting, and proper mounting will be prevented. Accordingly, the device is preferably designed so that a maximum clearance distance 126 between the head shaft 29 and an outer edge 128 of the mounting end 20 is less than or equal to one-half of the mounting depression diameter 122, i.e. about 13 mm in the case of a standard computer mounting depression.

In yet another embodiment of the invention, a security device and method for using the device is provided for use with portable equipment which does not have a prefabricated security slot opening 12 in the chassis 14. The device includes any of the embodiments of the invention described above, in combination with a slot opening adapter plate 130, shown in FIG. 8. The adaptor plate features a raised portion 132 having a slot opening 12' for receiving the slot-mating head 27. The adaptor plate is secured to the chassis 14 of a portable equipment unit by peeling back an adhesive protective sheet 134 to expose an adhesive backing 136 on the plate, and affixing the adhesive backing to the chassis. The raised portion of the slot adaptor must provide a depression 138 beneath and surrounding an inner wall 140 of the raised portion to provide sufficient clearance for the head, i.e. the depression must be at least as deep as a height dimension 142 of the head.

The body 16 and other parts of the security device 10 10', 10'", 10"" can be constructed from any material having suitable hardness to resist breakage or cutting, such as steel, aluminum, other metals or hardened plastics. Similarly, the body and other parts of the invention can be manufactured by any of a variety of production process, such as casting, milling or molding.

In view of the above, the invention is not to be limited to the above description but should be determined in scope by the claims which follow.

What is claimed is:

1. A security device for securing portable computing equipment having an elongated security slot opening in a chassis of the equipment, comprising:

a main body defining a central axis, a head locking aperture, a mounting end and a terminal end;

a slot-mating head having a transverse limb, the head supported on a shaft attached to the mounting end, the head being sized for insertion into the security slot opening, and the head and shaft defining an insertion plane;

an elongated head locking member positioned outside of the insertion plane, the head locking member being relatively axially movable with respect to the slot-mating head through the head locking aperture;

securing means for securing the head locking member in a head locking position after the head locking member has been axially advanced through the head locking aperture into the slot opening; and attachment means for attaching the security device to an anchoring tether, wherein the body further defines a hollow cavity having a transverse, spring-retaining wall defining a head locking bore intermediate the mounting and terminal ends, wherein the mounting end has an axially movable head support defining the head locking aperture, and a compression spring mounted between the head support and retaining wall, wherein the head locking aperture is positioned for registration with the bore and is threaded for engagement of the head locking member, wherein the head locking member is an elongated screw cooperatively threaded with the aperture and movably mounted in the aperture and the bore, and wherein the terminal end of the body defines a pair of opposed anchoring holes for accepting the anchoring tether and a separate, blockable access opening to permit selective access to the screw.

2. A security device for securing portable computing equipment having an elongated security slot opening in a chassis of the equipment, comprising:

a head support defining a head locking aperture;

a slot-mating head attached to the head support by an elongated shaft, the head having a transverse limb, the head being sized for insertion into the security slot opening, and the head and shaft defining an insertion plane;

a unitary main body defining a central axis, a mounting end, a terminal end, and a cavity in the mounting end for receiving the head support and permitting reciprocal, axial movement thereof and having selective rotation means for permitting selective rotation of the head support with respect to the body;

an elongated, head locking member axially moveable with respect to the slot-mating head and engageable with the head locking aperture;

securing means for securing the head locking member in a head locking position after the head locking member has been advanced through the head locking aperture into the slot opening; and attachment means for attaching the security device to an anchoring tether, wherein the selective rotation means is a key on the head support and a keyway within the cavity to provide for angular fixation of the head support relative to the body.

3. The security device of claim 2, including a plurality of keyways for selectably engaging the head support key to provide for selectable angular fixation of the head support relative to the body.

4. A security device for securing portable computing equipment having an elongated security slot opening in a chassis of the equipment, comprising:

a head support defining a head locking aperture;

a slot-mating head attached to the head support by an elongated shaft, the head having a transverse limb, the head being sized for insertion into the security slot opening, and the head and shaft defining an insertion plane;

a unitary main body defining a central axis, a mounting end, a terminal end, and a cavity in the mounting end for receiving the head support and permitting reciprocal, axial movement thereof and having selective rotation means for permitting selective rotation of the head support with respect to the body;

an elongated, head locking member axially moveable with respect to the slot-mating head and engageable with the head locking aperture;

securing means for securing the head locking member in a head locking position after the head locking member has been advanced through the head locking aperture into the slot opening; and attachment means for attaching the security device to an anchoring tether, wherein the body further defines a hollow cavity having a retaining rim and a transverse wall, the transverse wall being located intermediate the mounting and terminal ends and defining a collar opening sized for engagement of a screw seating collar, wherein the mounting end has an axially movable head support defining the head locking aperture, wherein the head locking aperture extends through the screw seating collar and is threaded for engagement of the head locking member, wherein the head locking member has an elongated screw cooperatively threaded with the aperture and movably mounted in the aperture, wherein the screw seating collar has a length greater than a length of the collar opening so that a head of the screw seats against a screw locking rim of the collar, and wherein the terminal end of the body defines a pair of opposed anchoring holes for accepting the anchoring tether and a separate, blockable access opening to permit selective access to the screw.

5. The security device of claim 4, wherein the mounting end is made of a compressible material to accommodate different side wall thicknesses among security slots.

6. A security device for securing portable computing equipment having an elongated security slot opening in a chassis of the equipment, comprising:

a unitary main body defining a central axis, a head locking aperture, a mounting end and a terminal end;

a slot-mating head having a transverse limb, the head supported on a shaft attached to the mounting end, the head being sized for insertion into the security slot opening, and the head and shaft defining an insertion plane;

an elongated head locking member positioned outside of the insertion plane, the head locking member being relatively axially movable with respect to the slot-mating head through the head locking aperture;

securing means for securing the head locking member in a head locking position after the head locking member has been axially advanced through the head locking aperture into the slot opening; and attachment means for attaching the security device to an anchoring tether, wherein the body further defines a hollow cavity having a spring retaining rim, wherein the head locking member is connected to an engagement piston axially movable within the cavity, wherein the cavity has a compression spring mounted between the retaining rim and the engagement piston, wherein the terminal end of the body defines a pair of opposed anchoring holes for accepting the anchoring tether, and wherein the engagement piston defines a transverse, piston locking channel alignable with the anchoring holes and sized for acceptance of the tether.

7. A method for securing portable computing equipment having an elongated security slot opening in a chassis of the equipment from theft, comprising:

providing a computing equipment security device having a slot-mating head and an axially movable head locking member attached to a mounting end of a body of the device, the head having a transverse limb and the head being sized for insertion into the security slot opening;

inserting the head into the security slot;

rotating the mounting end to rotate the head relative to a longitudinal axis of the slot opening and to align the head locking member with the slot opening;

axially advancing the head locking member into the slot opening to prevent rotation of the mounting end and removal of the head from the slot;

securing the head locking member to prevent its withdrawal from the slot; and attaching an anchoring tether to the security device and to a stationary object to secure the portable equipment from theft; and, axially adjusting a position of the head so that a seating distance between the head and body is approximately the same as a wall thickness of the slot opening.

8. A method for securing portable computing equipment having an elongated security slot opening in a chassis of the equipment from theft, comprising:

providing a computing equipment security device having a slot-mating head and an axially movable head locking member attached to a mounting end of a body of the device, the head having a transverse limb and the head being sized for insertion into the security slot opening;

inserting the head into the security slot;

rotating the mounting end to rotate the head relative to a longitudinal axis of the slot opening and to align the head locking member with the slot opening;

axially advancing the head locking member into the slot opening to prevent rotation of the mounting end and removal of the head from the slot;

securing the head locking member to prevent its withdrawal from the slot; and attaching an anchoring tether to the security device and to a stationary object to secure the portable equipment from theft; and, selectively rotating the body with respect to the head and head locking member so that a tether attachment structure of the body is aligned with a path of the anchoring tether.

* * * * *